US011608572B2

(12) United States Patent
Sick et al.

(10) Patent No.: US 11,608,572 B2
(45) Date of Patent: Mar. 21, 2023

(54) ARTIFICIAL TURF WITH MARBLED MONOFILAMENT

(71) Applicant: Polytex Sportbelage Produktions-GmbH, Grefrath (DE)

(72) Inventors: Stephan Sick, Willich (DE); Dirk Sander, Kerken (DE); Bernd Jansen, Nettetal (DE); Dirk Schmitz, Weeze (DE)

(73) Assignee: Polytex Sportbelage Produktions-GmbH, Grefrath (DE)

( * ) Notice: Subject to any disclaimer, the term of this patent is extended or adjusted under 35 U.S.C. 154(b) by 68 days.

(21) Appl. No.: 16/925,393

(22) Filed: Jul. 10, 2020

(65) Prior Publication Data

US 2020/0340144 A1 Oct. 29, 2020

Related U.S. Application Data

(63) Continuation of application No. 16/091,339, filed as application No. PCT/EP2017/057726 on Mar. 31, 2017, now abandoned.

(30) Foreign Application Priority Data

Apr. 4, 2016 (EP) ..... 16163664

(51) Int. Cl.
*D01F 8/06* (2006.01)
*D01D 5/08* (2006.01)
(Continued)

(52) U.S. Cl.
CPC ..... *D01F 8/06* (2013.01); *D01D 5/08* (2013.01); *D01D 5/0885* (2013.01); *D01D 5/098* (2013.01);
(Continued)

(58) Field of Classification Search
CPC ... E01C 13/08; Y10T 428/23993; D02G 3/02; D02G 3/44; D02G 3/445; D01F 1/06;
(Continued)

(56) References Cited

U.S. PATENT DOCUMENTS 5,587,118 A 12/1996 Mallonee
5,593,768 A * 1/1997 Gessner ..... B01D 39/1623 442/346
(Continued)

FOREIGN PATENT DOCUMENTS

CN 1486375 A 3/2004
CN 1557870 A 12/2004
(Continued)

OTHER PUBLICATIONS

Paul, D.R. "Chapter 16—Fibers from Polymer Blends." Polymer Blends. Elsevier Inc, 1978. 167-217. Web.*
(Continued)

*Primary Examiner* — Cheryl Juska
(74) *Attorney, Agent, or Firm* — Harness, Dickey & Pierce, P.L.C.

(57) ABSTRACT

A method of manufacturing artificial turf creating a liquid polymer mixture, wherein the polymer mixture is at least a two-phase system. A first one of the phases includes a first polymer and a first dye, and a second one of the phases of the polymer mixture includes a second polymer and a second dye. The second dye has a different color than the first dye, the second polymer being of the same or of a different type as the first polymer. The first and the second phase are immiscible, the first phase forming polymer beads within the second phase. The method further includes extruding the polymer mixture into a monofilament including a marbled pattern of the first and second color; quenching the monofilament; reheating the monofilament; stretch-
(Continued)

ing the reheated monofilament to deform the polymer beads into threadlike regions and to form the monofilament into an artificial turf fiber; and incorporating the artificial turf fiber into an artificial turf backing.

13 Claims, 8 Drawing Sheets

(51) Int. Cl.

| | |
|---|---|
| ***D01D 5/36*** | (2006.01) |
| ***D01F 1/06*** | (2006.01) |
| ***E01C 13/08*** | (2006.01) |
| ***D01F 6/46*** | (2006.01) |
| ***D01F 6/92*** | (2006.01) |
| ***D01D 10/02*** | (2006.01) |
| ***D01F 1/02*** | (2006.01) |
| ***D01F 8/12*** | (2006.01) |
| ***D02J 1/22*** | (2006.01) |
| ***D01D 5/088*** | (2006.01) |
| ***D01D 5/098*** | (2006.01) |
| ***D01F 6/90*** | (2006.01) |

(52) U.S. Cl.
CPC ..... *D01D 5/36* (2013.01); *D01D 10/02* (2013.01); *D01F 1/02* (2013.01); *D01F 1/06* (2013.01); *D01F 6/46* (2013.01); *D01F 6/90* (2013.01); *D01F 6/92* (2013.01); *D01F 8/12* (2013.01); *D02J 1/22* (2013.01); *E01C 13/08* (2013.01); *D10B 2505/202* (2013.01)

(58) Field of Classification Search
CPC ..... D01F 1/10; D01F 6/46; D01F 8/00; D01F 8/06; D01F 8/12; D01F 1/02; D01F 1/04; D01F 6/90; D01F 6/92; D01D 5/098; D01D 5/0885; D01D 5/08; D01D 5/088; D01D 5/36; D01D 10/02; D10B 2321/021; D10B 2321/022; D10B 2331/02; D10B 2505/202; D02J 1/22
See application file for complete search history.

(56) References Cited

U.S. PATENT DOCUMENTS

| | | | | |
|---|---|---|---|---|
| 2004/0086664 | A1 | 5/2004 | Seaton | |
| 2004/0180200 | A1 | 9/2004 | Bertamini et al. | |
| 2007/0154661 | A1 | 7/2007 | Stroppiana et al. | |
| 2010/0173102 | A1 | 7/2010 | Van Reijen | |
| 2011/0305886 | A1 | 12/2011 | Phan et al. | |
| 2012/0125474 | A1 | 5/2012 | Frenken et al. | |
| 2017/0121856 | A1 | 5/2017 | Sick et al. | |
| 2018/0177254 | A1* | 6/2018 | Neuman | A41G 1/009 |
| 2019/0100857 | A1* | 4/2019 | Sick | D01F 1/06 |
| 2020/0308777 | A1* | 10/2020 | Sick | D01F 9/127 |
| 2020/0385936 | A1* | 12/2020 | Sick | D06N 7/0071 |
| 2021/0238771 | A1* | 8/2021 | Sick | D06N 7/0065 |

FOREIGN PATENT DOCUMENTS

| | | | | |
|---|---|---|---|---|
| CN | 102010542 | A | | 4/2011 |
| CN | 103531311 | A | | 1/2014 |
| CN | 105377391 | A | | 3/2016 |
| EP | 0015556 | A1 | | 9/1980 |
| JP | 09220781 | A | * | 8/1997 |
| KR | 2143595 | B1 | * | 8/2020 |
| WO | WO-2015/144223 | A1 | | 10/2015 |

OTHER PUBLICATIONS

JP 09-220781 translation, Aug. 26, 1997 (Year: 1997).*
Lee, Jae-Dong et al., "Effects of Mixing Procedures on Properties of Compatibilized Polyoropylene/Nylon 6 Blends," mid-Dec. 1995, Polymer Engineering and Science, vol. 35, No. 23, pp. 1821-1833.*
G. Odian, Principles of Polymerization, 1981, Wiley-Interscience, 2nd ed., section 1-5a, Crystalline and Amorphous Behavior, p. 25, 1st paragraph and section 1-5b, Determinants of Polymer Crystallinity, p. 29, 1st paragraph.*
International Search Report PCT/ISA/210 for International Application No. PCT/EP2017/057726 dated May 8, 2017.
Written Opinion of the International Searching Authority PCT/ISA/237 for International Application No. PCT/EP2017/057726 dated May 8, 2017.
International Preliminary Report on Patentability for Application No. PCT/EP2017/057726 dated Jul. 24, 2018.
Search Report for European Application No. 16163664.2 dated May 23, 2016.
Office Action for corresponding Canadian Application No. 3,015,175 dated Sep. 26, 2019.
Chinese Office Action dated Apr. 1, 2020 for CN Application No. 2017800177817.
Non-Final Office Action dated Jan. 22, 2020 in U.S. Appl. No. 16/091,339.
Second Office Action dated Jan. 7, 2021 in Chinese Application No. 201780017781.7.

* cited by examiner

ARTIFICIAL TURF WITH MARBLED MONOFILAMENT

CROSS-REFERENCE TO RELATED APPLICATIONS

This application is a Continuation of U.S. application Ser. No. 16/091,339, filed on Oct. 4, 2018, which is a national phase under 35 U.S.C. § 371 of PCT International Application No. PCT/EP2017/057726 which has an International filing date of Mar. 31, 2017, which claims priority to European Application No. 16163664.2, filed Apr. 4, 2016, the entire contents of each of which are hereby incorporated by reference.

FIELD OF THE INVENTION

The invention relates to artificial turf and the production of artificial turf which is also referred to as synthetic turf. The invention further relates to the production of fibers that imitate grass, and in particular a product and a production method for artificial turf fibers based on polymer blends and of the artificial turf carpets made from these artificial turf fibers.

BACKGROUND AND RELATED ART

Artificial turf or artificial grass is surface that is made up of fibers which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

An advantage of using artificial turf is that it eliminates the need to care for a grass playing or landscaping surface, like regular mowing, scarifying, fertilizing and watering. Watering can be e.g. difficult due to regional restrictions for water usage. In other climatic zones the re-growing of grass and re-formation of a closed grass cover is slow compared to the damaging of the natural grass surface by playing and/or exercising on the field. Artificial turf fields though they do not require a similar attention and effort to be maintained, may require some maintenance such as having to be cleaned from dirt and debris and having to be brushed regularly. This may be done to help fibers stand-up after being stepped down during the play or exercise. Throughout the typical usage time of 5-15 years it may be beneficial if an artificial turf sports field can withstand high mechanical wear, can resist UV, can withstand thermal cycling or thermal ageing, can resist inter-actions with chemicals and various environmental conditions. It is therefore beneficial if the artificial turf has a long usable life, is durable, and keeps its playing and surface characteristics as well as appearance throughout its usage time.

For many applications, it is intended to produce artificial turf that faithfully reproduces the appearance of natural grass.

In addition, it may be desirable to produce artificial turf that can easily be manufactured and that has a marbled color pattern.

United States Patent application US 201 0/01 731 02 A1 discloses an artificial grass that is characterized in that the material for the cladding has a hydrophilicity which is different from the hydrophilicity of the material which is used for the core.

US 20070154661A1 describes a synthetic grass yarn which reproduces natural grass. An extruder is fed with material such as PE in the form of stripes of different colors. The extruder is controlled such that the extruded product does not present uniform coloration. However, said document does not disclose how an homogeneous intermixing of PE stripes of different colors during the extrusion process can be prevented.

WO 2015/144223 A1 describes a method of manufacturing artificial turf. The method comprising the steps of: creating a polymer mixture, wherein the polymer mixture is at least a three-phase system. The polymer mixture comprises a first polymer, a second polymer, and a compatibilizer. The first polymer and the second polymer are immiscible. The first polymer forms polymer beads surrounded by the compatibilizer within the second polymer. The method comprises extruding the polymer mixture into a monofilament, quenching, reheating and stretching the monofilament to deform the polymer beads into threadlike regions and incorporating the artificial turf fiber into an artificial turf carpet.

SUMMARY

The invention provides for a method of manufacturing artificial turf with a monofilament comprising a marbled pattern of a first and a second color in the independent claims. Embodiments are given in the dependent claims.

In one aspect the invention provides for a method of manufacturing artificial turf. The method comprises the steps of:

creating a liquid polymer mixture. The polymer mixture is at least a two-phase system. A first one of the phases comprises a first polymer and a first dye. A second one of the phases of the polymer mixture comprises a second polymer and a second dye. The second dye has a different color than the first dye. The second polymer is of the same or of a different type as the first polymer. The first and the second phases are immiscible. The first phase forms polymer beads within the second phase;

extruding the polymer mixture into a monofilament comprising a marbled pattern of the first and second color;

quenching the monofilament;

reheating the monofilament;

stretching the reheated monofilament to deform the polymer beads into threadlike regions and to form the monofilament into an artificial turf fiber;

incorporating the artificial turf fiber into an artificial turf backing.

Embodiments of the invention may use first and second colors that represent colors occurring in natural grass, e.g. green and yellow, or bright-green and dark-green, or green and bright-brown or the like. Said embodiments may have the advantage that the appearance of natural grass is highly faithfully reproduced. In other embodiments, other color combinations may be used for generating a marbled but not necessary natural grass-like pattern.

In a further beneficial aspect, the creation of a liquid polymer mixture wherein the two different dyes are separated in two different phases wherein one of the phases is "emulsified" in the second phase in the form of beads is advantageous as it is not necessary to use or create customized extruders which mechanically prevent a premature intermixing of the two dyes, thereby ensuring that a monofilament with a marbled pattern rather than a monofilament with a color being the intermediate of the first and second color is created. Thus, embodiments of the invention allow using the same extrusion machinery for creating marbled monofilaments as is used for creating monochrome monofilaments. This may reduce production costs and may increase the diversity of artificial turf types that can be created with a single melting- and extrusion apparatus.

Moreover, complicated coextrusion, requiring several extrusion heads to feed one complex spinneret tool is not needed in order to provide for artificial turf that accurately reproduces the texture of natural grass.

In a further beneficial aspect, embodiments of the invention may guarantee that the generation of the liquid polymer mixture that is to be extruded and the extrusion process itself does not generate a homogeneous mixture of the two dyes. If e.g. two or more PE stripes based on the same polymer type and comprising pigments of different colors would concurrently be fed to an extruder, the temperature, pressure, extrusion time and other extrusion parameters would have to be very carefully chosen to prevent an intermixing of different dyes that would result in an extrusion product having a homogeneous intermediate color. To the contrary, embodiments of the invention provide for an artificial turf fiber generation method that can generate marbled fibers and that is particularly robust against process parameters such as increased temperatures, prolonged time of stirring and intermixing different polymers in the extruder, pressure, and other factors that could result in the generation of a homogeneous mixture of the two dyes. This is because the at least two polymers with the different dyes form different phases and thus do not intermix even under high temperature and/or extensive stirring conditions.

In a further beneficial aspect, embodiments of the invention may allow to produce monofilaments having a particularly fine granular marbled pattern, because small droplets of one phase can be generated and stabilized in emulsified form in the liquid polymer mixture until the mixture is extruded (see e.g. the marbled pattern of a single monofilament depicted in FIG. 3*b*).

In a further beneficial aspect, the second polymer and any immiscible polymers may not delaminate from each other, even in case two different types of polymers are used as the first and second polymer. The thread-like regions are embedded within the second polymer. It is therefore impossible for them to delaminate.

According to embodiments, a compatibilizer is added to the polymer mixture and interfaces the first and second polymers, thereby further preventing the delamination of the two different types of polymers. Preferably, the compatibilizer is added to polymer mixture whose phase separation is caused by a polarity difference between a polar and an apolar polymer.

The use of the first polymer and the second polymer enables the properties of the artificial turf fiber to be tailored. For instance a softer plastic, e.g. PE. may be used for the polymer having the larger mass fraction, e.g. the second polymer, to give the artificial turf a more natural grass-like and softer feel. A more rigid plastic, e.g. PA, may be used for the polymer having the smaller mass fraction, e.g. the first polymer, or other immiscible polymers to give the artificial turf more resilience and stability and the ability to spring back after being stepped or pressed down.

A further advantage may possibly be that the thread-like regions are concentrated, due to fluid dynamics during the extrusion process, in a central region of the monofilament during the extrusion process, while there is still a significant portion of the thread-like regions also on the surface of a monofilament to produce the marble pattern appearance. Thus, the more rigid material may be concentrated in the center of the monofilament and a larger amount of softer plastic on the exterior or outer region of the monofilament. This may further lead to an artificial turf fiber with more grass-like properties both in terms of rigidity, surface smoothness and surface coloration and texture.

Compared with a subsequent coloring of an artificial turf fiber, embodiments of the method result in a monofilament that comprises the marble color pattern not only on its surface but also inside. In case a filament should be split, its surface abraded or otherwise damaged, the marble color pattern will not be removed as it is not confined to the surface of the monofilament.

A further advantage may be that the artificial turf fibers have improved long term elasticity. This may require reduced maintenance of the artificial turf and require less brushing of the fibers because they more naturally regain their shape and stand up after use or being trampled.

Approach I: Separating Phases by Using Polymers Having Different Polarity

According to embodiments the first and the second polymers differ from each other in that one of them is a polar polymer and the other one is an apolar polymer. The polymers are chosen such that the polarity difference is sufficient to cause a phase separation of the first phase consisting mainly of the first polymer and the second phase consisting mainly of the second polymer.

According to embodiments, the first polymer is a polar polymer, e.g. polyamide (PA).

According to embodiments, the second polymer is a non-polar polymer, e.g. polyethylene (PE). According to embodiments, the liquid polymer mixture is at least a three-phase system. The third one of the phases comprises a compatibilizer. The first phase forms polymer beads surrounded by the third phase within the second phase.

According to embodiments, the polymer mixture comprises the compatibilizer in a concentration of 0.05%-8% by weight, more preferentially 0.2-4%, more preferentially 0.4-2% by weight.

The polymer bead comprises crystalline portions and amorphous portions. Stretching the polymer beads into threadlike regions causes an increase in the size of the crystalline portions relative to the amorphous portions.

According to embodiments, the creating of the polymer mixture comprises the steps of:

forming a first mixture by mixing the first polymer with the compatibilizer;

heating the first mixture;

extruding the first mixture;

granulating the extruded first mixture;

mixing the granulated first mixture with the second polymer; and heating the granulated first mixture with the second polymer to form the polymer mixture.

According to embodiments, the polymer mixture comprises 1 to 30 percent by weight the first polymer. According to embodiments, the polymer mixture comprises 1 to 20 percent by weight the first polymer. According to embodiments, the polymer mixture comprises 5 to 10 percent by weight the first polymer. In said examples, the balance of the weight may be made up by such components as the second polymer and any other additional additives put into the polymer mixture.

According to embodiments, the polymer mixture comprises 70 to 90 percent by weight the second polymer. In said examples, the balance of the weight may be made up by such components as the first polymer and any other additional additives put into the polymer mixture.

According to embodiments, the first polymer is any one of the following: polyamide, polyethylene terephthalate (PET), and polybutylene terephthalate (PBT).

According to embodiments, the second polymer is any one of the following: polyethylene, polypropylene, and a mixture thereof.

For example, PA may be used as the second polymer, PE may be used as the second polymer, and a compatibilizer like MAH is used for embedding PA beads extruded to thread-like regions in the PE mass. According to one particular example, PA 6.6 or PA6.6 having a melt mass flow rate (measured at 190°/2.16 kg) of 5 is used as the first polymer and a PE having a melt flow rate of 1.8 (measured at 190°/2.16 kg) is used as the second polymer. The melt flow rate difference would of said two polymers would not be sufficient for inducing phase separation, but the polarity difference is sufficient to allow for a separation of the first and second polymer into different phases which can be separated from each other by a compatibilizer forming a third phase.

According to embodiments, the compatibilizer is any one of the following: grafted maleic acid anhydride (MAH), ethylene ethyl acrylate (EEA), a maleic acid grafted on polyethylene or polyamide; a maleic anhydride grafted on free radical initiated graft copolymer of polyethylene, SEBS (styrene ethylene butylene styrene), EVA (ethylene-vinyl acetate), EPD (ethylene-propylene diene), or polypropylene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer.

Using a mixture of polymers of different types, e.g. the apolar polyethylene and the polar polyamide as described above has the advantage that an artificial turf fiber is created that shows a marbled color pattern and that has increased durability against wear and tear due to the more rigid PA and at the same time a smoother surface and increased elasticity compared to pure-PA based monofilaments. The compatibilizer prevents delaminization.

Approach II: Separating Phases By Using Different Polymers With Different Melt Mass Flow Rates According to embodiments, the method comprising generating the liquid polymer mixture by heating a solid mixture of the first and second polymers at least until the first and second polymers are melted.

The phase separation of the first and the second phase is achieved by selecting the first and the second polymer such that the difference in melt mass-flow rate of the first and second polymer results in a phase separation of a molten mixture of the first and second polymer. For example, this may be determined experimentally by mixing polymers of different melt mass-flow rates and then heating the polymer mixture for testing if the melt mass flow rate difference is sufficient for generating a phase separation at a particular temperature.

According to embodiments, the polymer with the smaller mass share of the polymer mixture has a melt mass-flow rate that differs by at least 3 g/10 min from the melt mass-flow rate (190° C./2.16 kg) of the polymer with the larger mass share.

According to embodiments, the first polymer (e.g. the one with the smaller mass share, e.g. a first PE variant) has a melt mass-flow rate (190° C./2.16 kg) of 0.5-5 g/10 min. The second polymer (e.g. the one with the larger mass share, e.g. a second polymer, e.g. a second PE variant) has a melt mass-flow rate (190° C./2.16 kg) of 8-100 g/10 min.

According to a first example, a first Linear low-density polyethylene (LLDPE) having a melt mass flow rate (measured at 190°/2.16 kg) of 4 is used as the first polymer and a second LLDPE having a melt flow rate of 20 (measured at 190°/2.16 kg) is used as the second polymer.

According to a second example, a first LLDPE having a melt mass flow rate (measured at 190°/2.16 kg) of 0.9 is used as the first polymer and a second LLDPE having a melt flow rate of 20 (measured at 190°/2.16 kg) is used as the second polymer.

The melt mass-flow rate is a function of the molecular weight and thus of the type and chain length of the polyolefin used. In practice, the melt mass flow rate can be derived from books or product descriptions or can be easily determined empirically, e.g. according to ASTM D1238, a standard test method for melt flow rates of thermoplastics by an extrusion plastometer.

According to embodiments, the first polymer is the polymer with the smaller mass share. The first polymer can be, for example, a first PE variant. The second polymer is the polymer with the larger mass share. The second polymer may be, for example, a second PE variant. The first and second PE variants have different melt mass-flow rates as described above. The melt mass-flow rates of a particular polymer variant are usually published by the manufacturers of a particular polymer type or can be easily determined empirically by standard melt flow measurements as defined, for example, in ASTM D1238.

According to some embodiments, a compatibilizer is not needed for approach II, e.g. in case the first and second polymer type are sufficiently similar in respect to their physic-chemical properties so that no delamination will occur. If this is not the case, a compatibilizer may be used as described for approach I.

Thanks to the two different approaches, a large number of polymer types can be combined for generating a marbled color impression. In many cases, this may be achieved without any additional production steps or chemical compounds. Additional desired effects may be achieved that result from the combination of two different polymers, e.g. an improved resistance to wear and tear, increased elasticity, surface-smoothness, rigidity, surface-roughness, and so on.

Further Embodiments of Both Approaches I and II

According to embodiments, the composition of the polymer mixture, the extrusion-mass temperature, the quenching bath temperature and/or the stretch factor prohibits the first dye from diffusing into the second phase and prohibits the second dye from diffusing into the first phase. Moreover, said conditions allow a sufficient number of polymer domains of a given phase to unify during quenching as to provide a marbled structure that can be resolved by a human eye and has the recurring pattern of threads of different colors as described above.

According to embodiments, the composition of the polymer mixture, the extrusion process conditions and/or the stretch factor are chosen such that the volume of the polymer phases is so large and the time during which the two different phases are liquid is so short that diffusion of the dyes to the respective other phase is prohibited.

According to embodiments, the extrusion is performed at a pressure of 40-140 bars, more preferentially between 60-100 bars, and more preferentially at a pressure of 70-90 bar, e.g. 80 bars.

According to embodiments, the polymer mixture at time of extrusion has a temperature of 190-260° C. ("extrusion-mass-temperature"), more preferentially 210-250° C., and even more preferentially 220-240° C.

According to embodiments, the stretch factor is in the range of 1.1-8, more preferentially in the range of 3-7 and even more preferentially in the range of 4.5-6. A "stretch factor" as used herein is the factor by with the length of a given artificial turf monofilament is prolonged by the stretching step.

According to embodiments, the quenching solution, e.g. a water bath, has a temperature (right after the extrusion nozzle or hole(s)) of 10-60° C., more preferentially between 25° C.-45° C., and even more preferentially between 32° C.-40° C. Said temperature of the quenching solution may be advantageous as it allows, within a defined time interval between extrusion of the monofilament and solidification of the multiple liquid polymer phases, multiple polymer domains of a particular phase to unify, thereby resulting in threads of the first polymer having a desired average thickness, before the solidification prohibits any further migration and fusion of polymer domains.

Moreover, the resulting time interval during which the polymer phases are liquid and during which dye can potentially diffuse to the other phase is so short that significant dye diffusion to the other phase is prohibited. Moreover, it has been observed that under high pressure and at turbulent flow condition in the liquid polymer mixture (as has been observed at extrusion), multiple polymer domains of a given phase do not unify. Under these "turbulent" conditions, the threads of the first polymer phase are often so thin that a marbled structure would not be observable if the extruded monofilament would solidify immediately after extrusion. However, by using a quenching liquid temperature and extrusion mass temperature as described above, the different polymer domains of the same phase have sufficient time to unify after the polymer mixture flow has become laminar, thereby forming threads whose size and thickness is large enough as to provide for a marbled color impression if viewed by a human eye, e.g. at a distance of 15 cm or less.

According to embodiments, the extrusion is performed at a pressure of 80 bar, the polymer mixture at time of extrusion has a temperature of 230° C., the stretch factor is 5 and the quenching solution, e.g. a water bath, has a temperature of 35° C.

According to embodiments, the first and second dyes respectively are an inorganic dye, an organic dye or a mixture thereof. The above mentioned conditions will basically prohibit a diffusion of the dyes into the respective other phase irrespective of the dyes' polarity or molecular weight.

This may be advantageous as the diffusion of the dyes into the respective other phase and thus a mixing of the dyes is prevented, thereby ensuring that a marbled color expression is generated for an arbitrary combination of first and second dyes.

According to embodiments, the polymer mixture comprises 0.2%-40%, more preferentially 1-15%, more preferentially 2-10% by weight of the first polymer. In said examples, the balance of the weight may be made up by such components as the second polymer and any other additional additives put into the polymer mixture.

According to embodiments, the polymer mixture comprises more than 60%, preferentially more than 70% by weight of the second polymer. It is possible that more than 90% of the polymer mixture consists of the second polymer. In said examples, the balance of the weight may be made up by such components as the first polymer and any other additional additives put into the polymer mixture.

According to embodiments, the marble pattern of the monofilament reproduces color patterns of natural grass.

According to embodiments, the first dye is an azo-nickel pigment complex in a concentration of 0.5-5, more preferentially of 1.5-2 percent by weight of the first phase. For example, the azo-nickel pigment "BAYPLAST®Gelb 5GN" of LANXESS may be used as the first dye. Preferentially, the first dye has a yellow, light green or yellow-green color.

According to embodiments, the second dye is phthalocyanine green in a concentration of 0.001-0.3% by weight, preferably 0.05-0.2% by weight of the second phase. Preferentially, the second dye has a green or dark green color. According to embodiments, the artificial turf fiber extends a predetermined length beyond the artificial turf backing, and wherein threadlike regions have a length less than one half of the predetermined length.

According to embodiments, the threadlike regions have a length less than 2 mm.

According to embodiments, the extrusion-mass temperature, stirring parameters of a mixer are chosen such that the average diameter of the beads in the molten polymer mixture before extrusion is less than 50 micrometer, preferentially between 0.1 to 3 micrometer, preferably 1 to 2 micrometer.

Said features in combination with quenching conditions that allow a unification of polymer domains of the same phase once the extruded polymer mix has reached laminar flow state may be advantageous as they will support a formation of a marble structure in which the occurrence of the two different colors changes preferentially every 50-1000 μm, more preferentially every 100-700 μm.

Thus, during extrusion, the polymer domains of the first polymer is very fine-granularly dispersed within the second polymer phase and the portions on the surface of the monofilaments showing the first color may form as coarse-grained structures by unification (merging) of multiple first phase domains after extrusion until the monofilament solidifies. This may allow for a better intermixing of the first and second polymer and prohibit delamination.

According to embodiments, the polymer mixture further comprises any one of the following: a wax, a dulling agent, a UV stabilizer, a flame retardant, an anti-oxidant, a pigment, and combinations thereof.

According to embodiments, the creation of the artificial turf fiber comprises forming the stretched monofilament into a yarn. Multiple, for example 4 to 8 monofilaments, could be formed or finished into a yarn.

According to embodiments, the creation of the artificial turf fiber comprises weaving, spinning, twisting, rewinding, and/or bundling the stretched monofilament into the artificial turf fiber. This technique of manufacturing artificial turf is known e.g. from United States patent application US 20120125474 A1.

According to embodiments, the incorporation of the artificial turf fiber into the artificial turf backing comprises: tufting the artificial turf fiber into the artificial turf backing and binding the artificial turf fibers to the artificial turf backing.

According to embodiments, the incorporation of the artificial turf fiber into the artificial turf backing comprises weaving the artificial turf fiber into the artificial turf backing.

In a further aspect, the invention relates to an artificial turf manufactured according to the method of any one of the embodiments described herein.

In a further aspect, the invention relates to an artificial turf comprising an artificial turf textile backing and an artificial turf fiber incorporated into the artificial turf backing: The artificial turf fiber comprises at least one monofilament comprising on its surface a marbled pattern of a first and a second color. The monofilament is a monofilament created in an extrusion step from a liquid polymer mixture. Each of the at least one monofilament comprises:

a first polymer in the form of threadlike regions, the first polymer comprising a first dye having the first color;

a second polymer, the second polymer comprising a second dye having the second color, wherein the threadlike regions are embedded in the second polymer, wherein the first polymer is immiscible in the second polymer.

According to embodiment the polymer mixture comprises between 80-90% by weight of the second polymer. In this example the balance of the weight may be made up by the first polymer, possibly a third polymer if it is present in the polymer mixture, a compatibilizer if it is present in the polymer mixture, and any other chemicals or additives added to the polymer mixture.

In some examples the stretched monofilament may be used directly as the artificial turf fiber. For example the monofilament could be extruded as a single fiber or filament (monofilament) and directly incorporated into an artificial turf backing.

In other examples the artificial turf fiber may be a bundle or group of several stretched monofilament fibers is in general cabled, twisted, or bundled together. In some cases the bundle is rewound with a so called rewinding yarn, which keeps the yarn bundle together and makes it ready for the later tufting or weaving process.

The monofilaments may for instance have a diameter of 50-600 micrometer in size. The yarn weight may typically reach 50-3000 dtex.

According to embodiments the polymer beads comprise crystalline portions and amorphous portions. The polymer mixture was likely heated during the extrusion process and portions of the first polymer and also the second polymer may have a more amorphous structure or a more crystalline structure in various regions. Stretching the polymer beads into the thread-like regions may cause an increase in the size of the crystalline portions relative to the amorphous portions in the first polymer. This may lead for instance to the first polymer to become more rigid than when it has an amorphous structure. This may lead to an artificial turf with more rigidity and ability to spring back when pressed down. The stretching of the monofilament may also cause in some cases the second polymer or other additional polymers also to have a larger portion of their structure become more crystalline. In a specific example of this the first polymer could be polyamide and the second polymer could be polyethylene. Stretching the polyamide will cause an increase in the crystalline regions making the polyamide stiffer. This is also true for other plastic polymers.

According to one embodiment according to approach II where the polymer mixture comprises a compatibilizer, the creating of the polymer mixture comprises the step of forming a first mixture by mixing the first polymer with the compatibilizer and the first dye. The creation of the polymer mixture further comprises the step of heating the first mixture, extruding the first mixture, granulating the extruded first mixture, mixing the granulated first mixture with the second polymer and the second dye, and heating the granulated first mixture with the second polymer to form the polymer mixture. This particular method of creating the polymer mixture may be advantageous because it enables very precise control over how the first polymer and compatibilizer (comprising the first dye) are distributed within the second polymer (comprising the second dye). For instance the size or shape of the extruded first mixture may determine the size of the polymer beads in the polymer mixture. In the aforementioned method of creating the polymer mixture for instance a so called one-screw extrusion method may be used.

According to alternative embodiments employable for approaches I as well as II, the polymer mixture may also be created by putting all of the components that make it up together at once. For instance the first polymer, the second polymer, the first and second dyes and the compatibilizer, if any, could be all added together at the same time. Other ingredients such as additional polymers or other additives could also be put together at the same time. The amount of mixing of the polymer mixture could then be increased for instance by using a two-screw feed for the extrusion. A mixture of the first polymer comprising the homogeneously distributed first dye may be fed through the first feed and a mixture of the second polymer comprising the homogeneously distributed second dye is fed through the second feed. In this case the desired distribution of the polymer beads can be achieved by using the proper rate or amount of mixing.

A "polymer mixture" as used herein encompasses a mixture of at least a first and a second polymer and also possibly with various additives added to the polymer mixture. The first and second polymers may be polymers of different types, e.g. polyamide and polyethylene. The first and second polymers may be of the same type, e.g. a polyethylene, but differing in one or more properties such as the average length of the carbon atom chain. The 'polymer mixture' consists of at least two different phases. If there are additional polymers or compatibilizers added to the system then the two-phase system may be increased to a three, four, five, or more phase system, whereby each or at least some of the further phases respectively comprise a due having a different color than all the other phases of the polymer mix. The first polymer and the second polymer are immiscible. In a three- or more phase system the polymers of each of the respective phases are immiscible. The first polymer forms polymer beads (optionally surrounded by a compatibilizer) within the second polymer. In addition, the third polymer of a third phase, if any, may form beads within the second phase (i.e., within the second polymer).

The term "domain", "polymer domain", "polymer bead" or "bead" may refer to a localized region, such as a droplet, of a polymer that is immiscible in the second polymer. The polymer beads may in some instances be round or spherical or oval-shaped, but they may also be irregularly-shaped.

A "phase" as used herein is a region of space (a thermodynamic system), throughout which many or all physical properties of a material are essentially uniform. Examples of physical properties include density, index of refraction, magnetization and chemical composition. A simple description is that a phase is a region of material that is chemically uniform, physically distinct, and mechanically separable. For example, a polymer mixture comprising a first and a second polymer may comprise in the molten state a first phase with the first polymer and a first dye and a second phase with a second polymer and a second dye.

A "polymer" as used herein is a polyolefin.

It is understood that one or more of the aforementioned embodiments of the invention may be combined as long as the combined embodiments are not mutually exclusive.

BRIEF DESCRIPTION OF THE DRAWINGS

In the following embodiments of the invention are explained in greater detail, by way of example only, making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
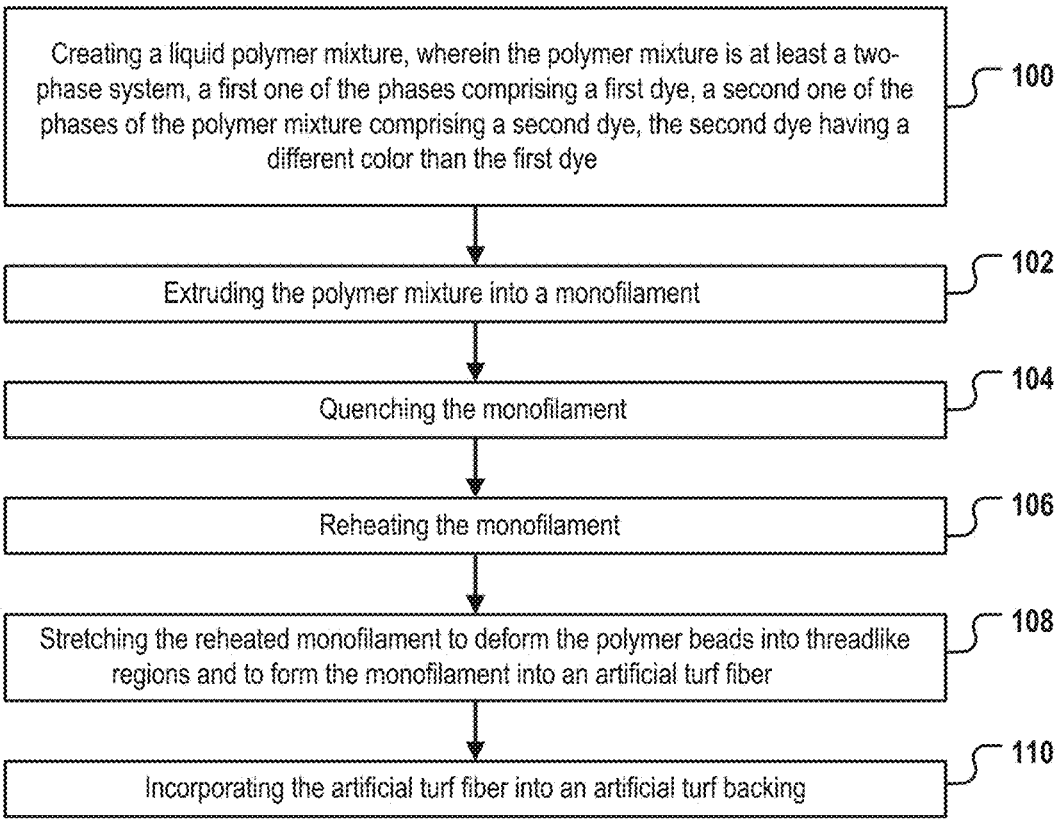
FIG. 1 shows a flowchart which illustrates an example of a method of manufacturing artificial turf.

FIG. 1 shows a flowchart which illustrates an example of a method of manufacturing artificial turf. First in step 100 a liquid polymer mixture is created. The polymer mixture is at least a two-phase system. The first phase comprises a first polymer and a first dye. The second phase comprises a second polymer and a second dye. According to some embodiments, the polymer mixture may comprise a third phase, e.g. a compatibilizer or a further polymer being immiscible both with the first and second phase. Optionally, the third phase may comprise a third dye having a different color than the first and second dyes. The first polymer and the second polymer are immiscible and the first and second dye basically are confined to their respective phase, i.e., there is—in the time until the liquid polymer mix is extruded and has solidified as monofilament—approximately no diffusion of a dye into another one of the phases. In other examples there may be additional polymers such as a third, fourth, or even fifth polymer that are also immiscible with the second polymer. There also may be additional compatibilizers which are used either in combination with the first polymer or the additional third, fourth, or fifth polymer, and there may be a respective dye in each of the further polymers.

The liquid polymer mix may be created by heating the first and second and any further polymer, if any, to a temperature that is above the melting point of said polymers. Thereby, the liquid polymer mixture may optionally be stirred at a stirring rate suitable to ensure that the molten first polymer is dispersed in the form of beads in the molten second polymer, whereby in some embodiments a third phase comprising the compatibilizer may build an envelope layer around the beads.

In the next step 102 the polymer mixture is extruded into a monofilament. Next in step 104 the monofilament is quenched or rapidly cooled down. Next in step 106 the monofilament is reheated. In step 108 the reheated monofilament is stretched to deform the polymer beads into thread-like regions and to form the monofilament into the artificial turf fiber.

Additional steps may also be performed on the monofilament to form the artificial turf fiber. For instance the monofilament may be spun or woven into a yarn with desired properties. Next in step 110 the artificial turf fiber is incorporated into an artificial turf backing. Step 110 could for example be, but is not limited to, tufting or weaving the artificial turf fiber into the artificial turf backing. Then in step 112 the artificial turf fibers are bound to the artificial turf backing. For instance the artificial turf fibers may be glued or held in place by a coating or other material. Step 112 is an optional step. For example if the artificial turf fibers are woven into the artificial turf backing step 112 may not need to be performed.

Figure 2:
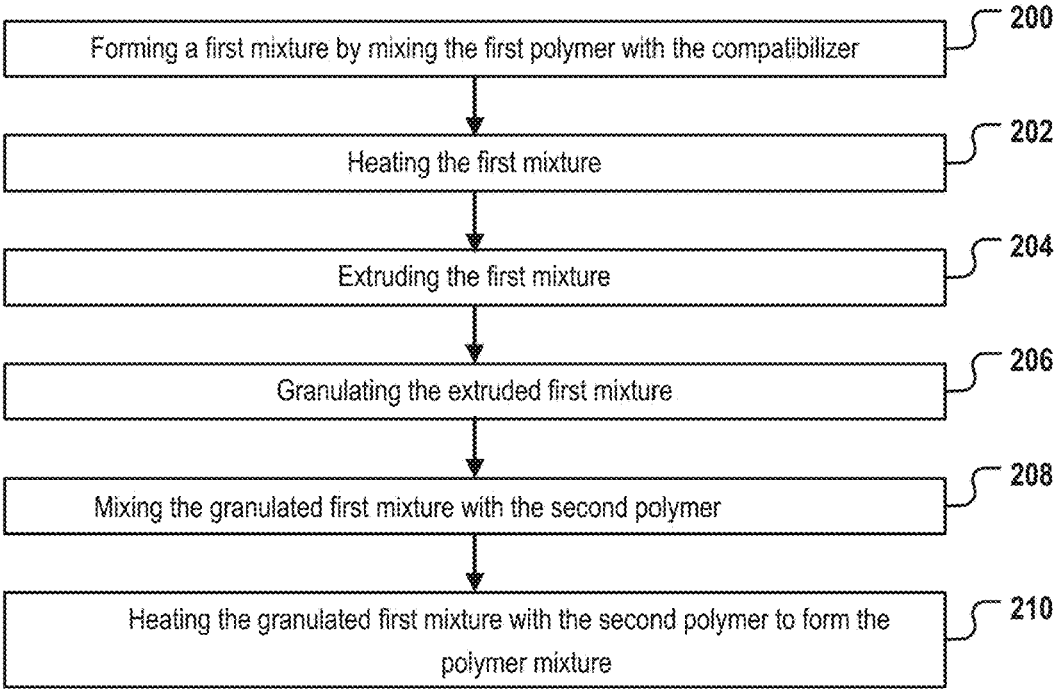
FIG. 2 shows a flowchart which illustrates one method of creating the polymer mixture.

FIG. 2 shows a flowchart which illustrates one method of creating the liquid polymer mixture. In this example the liquid polymer mixture to be created is a three-phase system. First in step 200 a first mixture is formed by mixing the first polymer with the first dye and the compatibilizer. Additional additives may also be added during this step, e.g. to increase flame or UV-resistance or improve the flowing properties of the polymer mixture. Next in step 202 the first mixture is heated. Next in step 204 the first mixture is extruded. Then in step 206 the extruded first mixture is then granulated or chopped into small pieces. Next in step 208 the granulated first mixture is mixed with the second polymer and the dye. Additional additives may also be added to the polymer mixture at this time. Finally in step 210 the granulated first mixture is mixed with the second polymer and the second dye and the resulting mixture is heated to form the liquid polymer mixture. The heating and mixing may occur at the same time. In the resulting liquid three phase mixture, the first phase may comprise the molten first polymer and the first dye, the second phase may comprise the molten second polymer and the second dye, and the third phase may comprise the compatibilizer. Some or all of the phases may comprise some or more of the further additives.

According to other embodiments (not shown), the first mixture is formed as granulated first mixture described above. In addition, a second granulated mixture is created by mixing the second polymer with the second dye. Additional additives may be added during this step. Then, the second mixture is heated and extruded. The extruded second mixture is then granulated or chopped into small pieces to provide the granulated second mixture. The granulated first and second mixtures are mixed together and are heated, thereby forming the liquid polymer mixture.

Figure 3A:
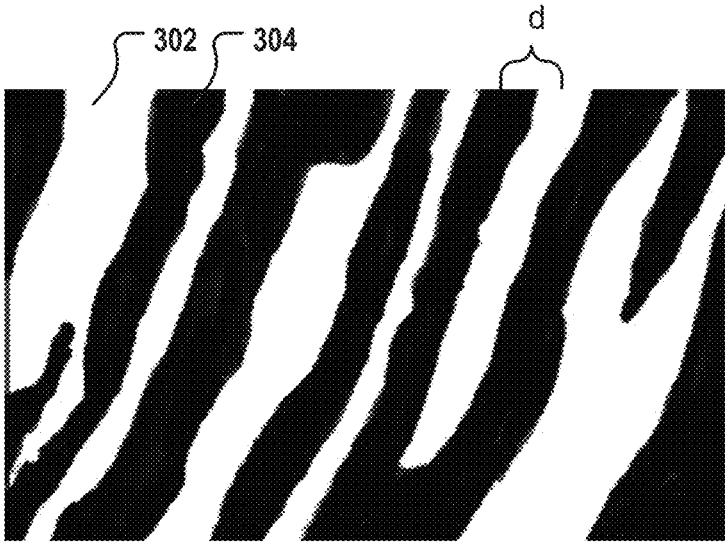
FIG. 3*a* shows a section of the marbled surface of a monofilament.

FIG. 3*a* shows a section of the surface of a monofilament according to embodiments of the invention. The "white" polymer domains or ("threads") 302 correspond to a first phase, the dark polymer domains 304 correspond to a second phase.

According to embodiments, the occurrence of polymer domains of the different phases and respective colors changes every 50-1000 μm. According to embodiments, the occurrence of polymer domains of the different phases and respective colors changes every 100-700 μm of the extruded and stretched monofilament. For example, the distance d between the center of a first and a second polymer domain may be about 300 μm.

Figure 3B:
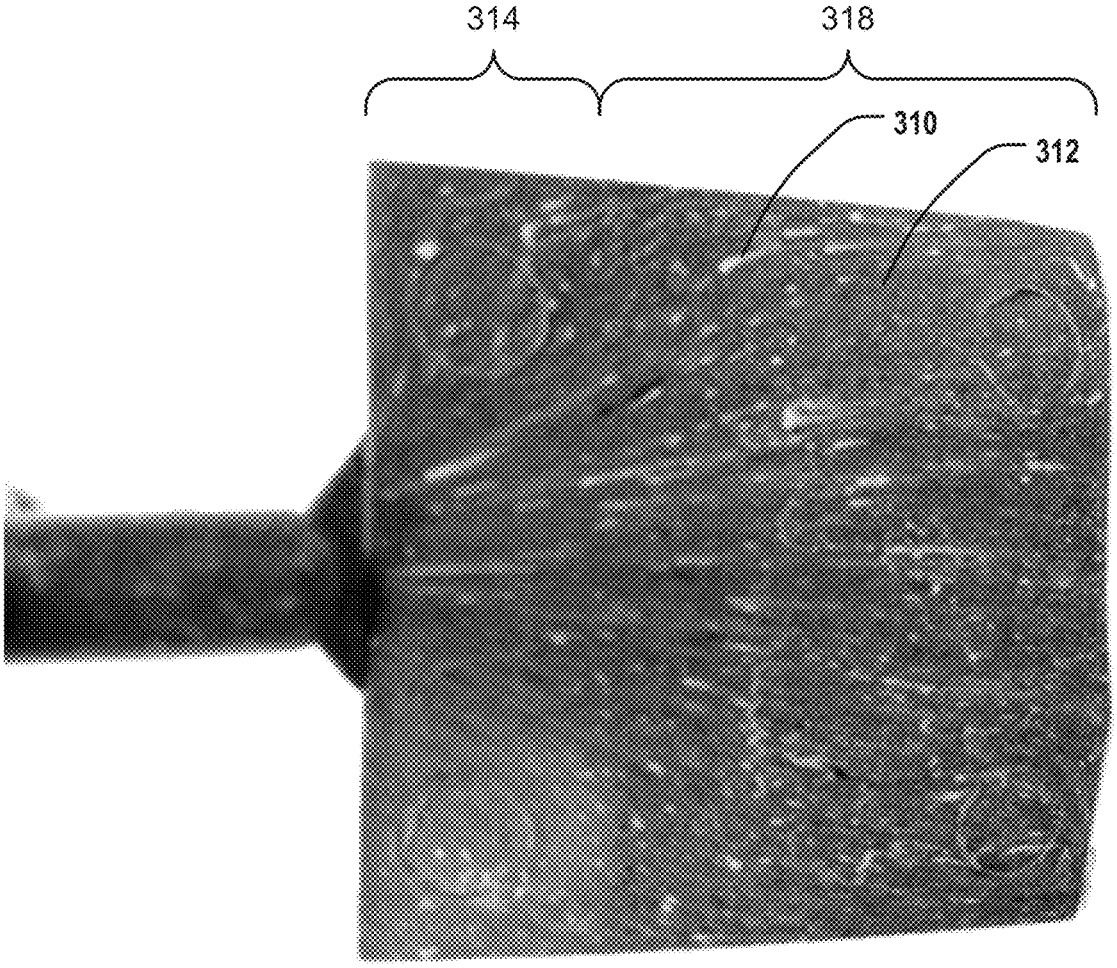
FIG. 3*b* shows a photograph of a moulded part generated in the extrusion process.

FIG. 3*b* shows a photograph of a moulded part generated in the extrusion process.

A first part 314 of the moulded part depicts an area in which a separation of phases occurred next to the extrusion hole. In this area, the molten polymer mixture is under high pressure and shows a turbulent flow characteristic. In area 314 (under high pressure conditions and at turbulent flow conditions), domains of the same phase do not have enough time to unify and to generate a visible marbled pattern as at the time of solidification, the individual polymer domains in region 314 are too thin.

A second part 318 of the moulded part depicts an area in which a separation of phases occurred sufficiently far away from the extrusion hole. In this area, that corresponds to the state of a monofilament at the end of the quenching process in a quenching liquid, the molten polymer mixture is under low pressure (e.g. pressure of environmental air) and shows a laminar flow characteristic. In area 318, domains of the same phase have enough time to unify to clearly visible thread-like regions 310 of a particular color (e.g. yellow or light-green) that can clearly be separated from the (e.g. green or dark-green) background polymer phase. Thus, area 318 that corresponds to the state of an extruded and quenched monofilament according to embodiments of the invention, comprises a visible marbled pattern as at the time of solidification, the individual polymer domains in region 318 change every 50-1000 μm, e.g. every 300 μm.

In the depicted example, the polymer domain 310 may be yellow and correspond to a first polymer consisting of polyamide, the polymer region 312 may be green and correspond to a PE or PP phase.

Figure 4:
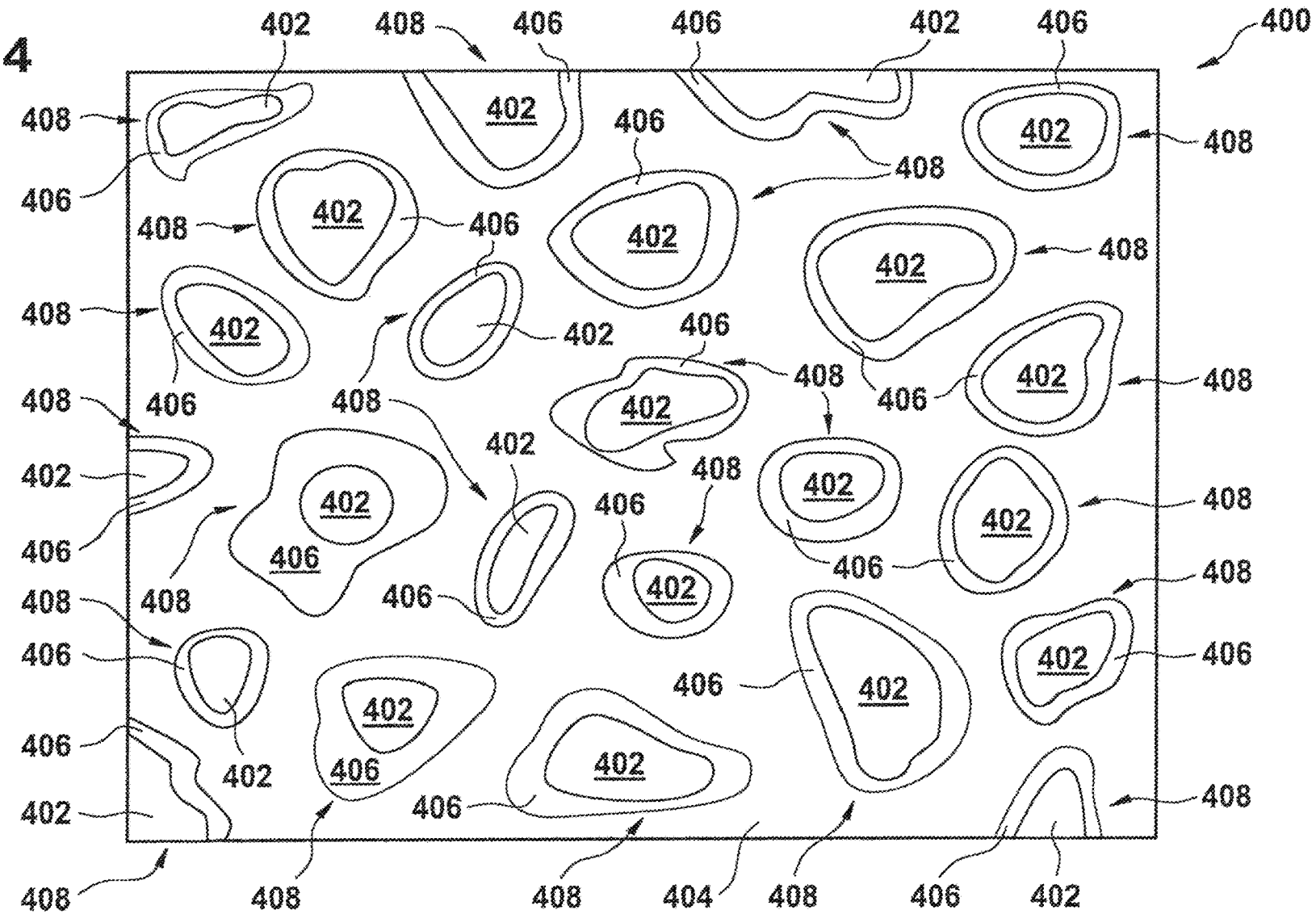
FIG. 4 shows a diagram which illustrates a cross-section of a polymer mixture.

FIG. 4 shows a diagram which illustrates a cross-section of a liquid polymer mixture 400. The polymer mixture 400 comprises at least a first phase with a first polymer and a first dye and a second phase 404 with a second polymer and a second dye. In the depicted embodiment, the polymer mixture comprises a third phase 406 that mainly or solely comprises a compatibilizer. The third phase may comprise the first or the second or a third dye or no dye at all. The first phase and the second phase are immiscible. The first polymer and the first phase is less abundant than the second phase (that mainly consists of the second polymer). The first phase 402 is shown as being surrounded by the compatibilizer phase 406 and being dispersed within the second phase 404. The first phase 402 surrounded by the compatibilizer phase 406 forms a number of polymer beads 408. The polymer beads 408 may be spherical or oval in shape or they may also be irregularly-shaped depending up on how well the polymer mixture is mixed and the temperature. The polymer mixture 400 is an example of a three-phase system. The compatibilizer phase 406 separates the first phase 402 from the second phase 406.

Figure 5:
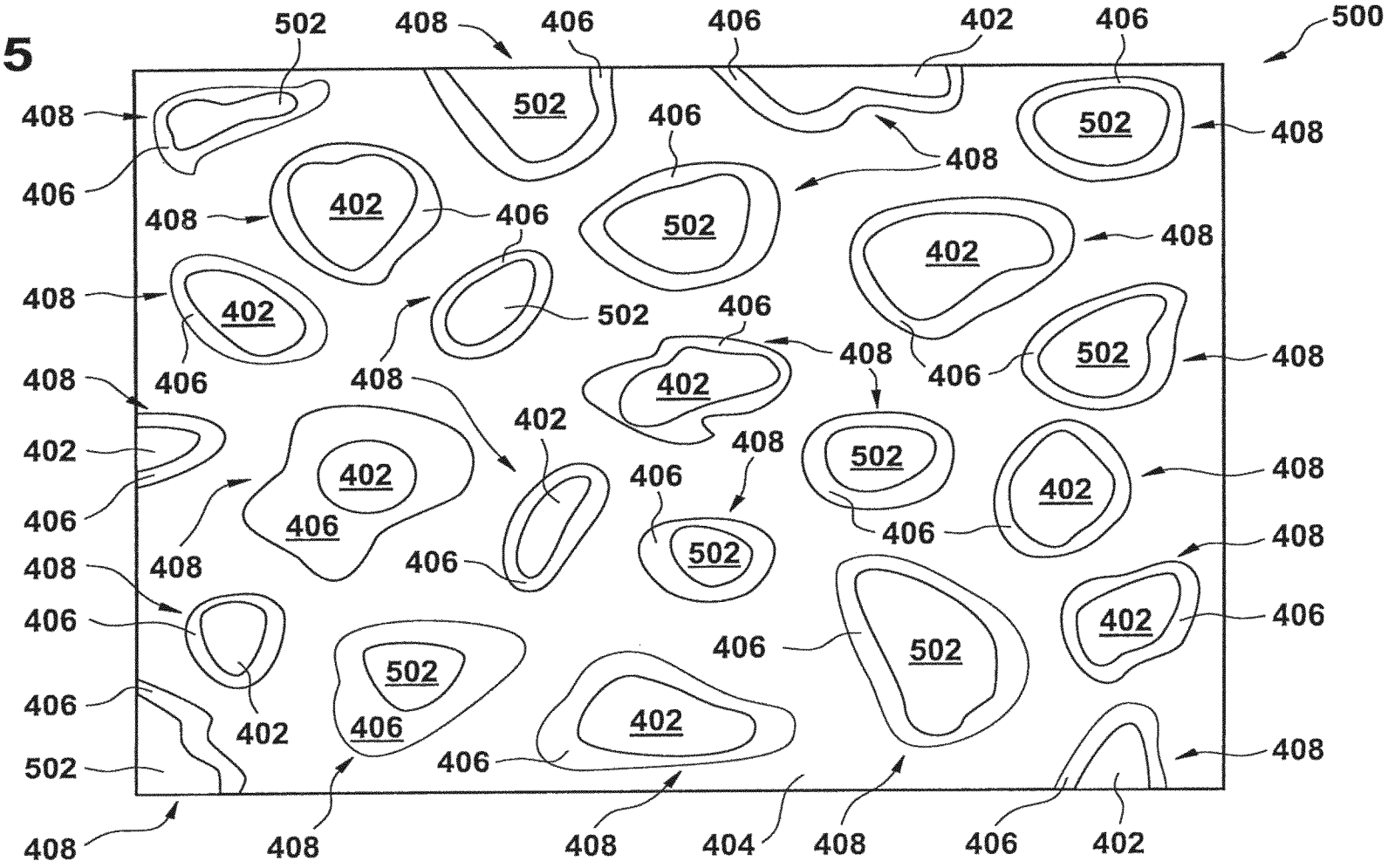
FIG. 5 shows a further example of a polymer mixture.

FIG. 5 shows a further example of a polymer mixture 500. The example shown in FIG. 5 is similar to that shown in FIG. 4 however, the polymer mixture 500 additionally comprises a fourth phase 502 with a third polymer. Some of the polymer beads 408 are now comprised of the third polymer. The polymer mixture 500 shown in FIG. 5 is a four-phase system. The four phases are made up of a first phase 402 comprising the first polymer and the first dye, a second phase 404 comprising the second polymer and the second dye, a third phase 406 comprising the compatibilizer and a fourth phase 502 comprising the further polymer 502. The first phase 402 and the fourth phase 502 are not miscible with each other and are not miscible with the second phase 404 or the third phase. The compatibilizer as a third phase separates the first phase from the second phase and separates the fourth phase 502 from the second phase 404.

In this example the same compatibilizer is used for both the first phase (and respective first polymer) and the fourth phase (and respective polymer). In other examples a different compatibilizer could be used for the first phase 402 and the fourth phase 502.

For example, the four phase polymer mixture may be created by forming a first granulated mixture and a second granulated mixture. The granulated first mixture is formed by mixing the first polymer, the first dye and the compatibilizer, heating the first mixture, extruding the first mixture and granulating the extruded first mixture. The granulated second mixture is formed by mixing the third polymer, a third dye and a compatibilizer (the same or a different one as used for creating the first mixture), heating the second mixture, extruding the second mixture and granulating the extruded second mixture. The creating of the polymer mixture further comprises mixing the first granulated mixture and the second granulated mixture with the second polymer and a second dye that will remain in the second phase resulting from the melting of the second polymer. The creating of the polymer mixture further comprises the step of heating the first granulated mixture and the second granulated mixture with the second polymer to form the liquid polymer mixture. This method may provide for a precise means of making the polymer mixture and controlling the size and distribution of the polymer beads using two different polymers and respective dyes that are embedded in a further (the second) polymer, typically PE comprising a still other ("second") dye. The resulting marble texture may thus comprise three different colors, a first color resulting from the first dye in the first phase, a second color resulting from the second dye in the second (PE) phase that surrounds the beads comprising the first or third polymer, and a third color resulting from the third dye in the third phase 502. Thus, complex marbled color patterns can be generated that faithfully reflect the appearance of natural grass.

As an alternative to this the polymer mixture could be made by adding the first polymer the first dye, the second polymer and the second dye, the third polymer and the one or more types of compatibilizer all together at the same time and then mixing them more vigorously. The first, second and fourth dye in this case have to be chosen such that they migrate to their respective phases after the mixture was melted. For example, the first dye may be polar and migrate into the first phase comprised mainly of a first, polar polymer. The second dye may be apolar and migrate into the second phase comprised mainly of a second, apolar polymer. The third dye could be covalently bound to the third polymer before the third polymer is added to the mixture.

Figure 6:
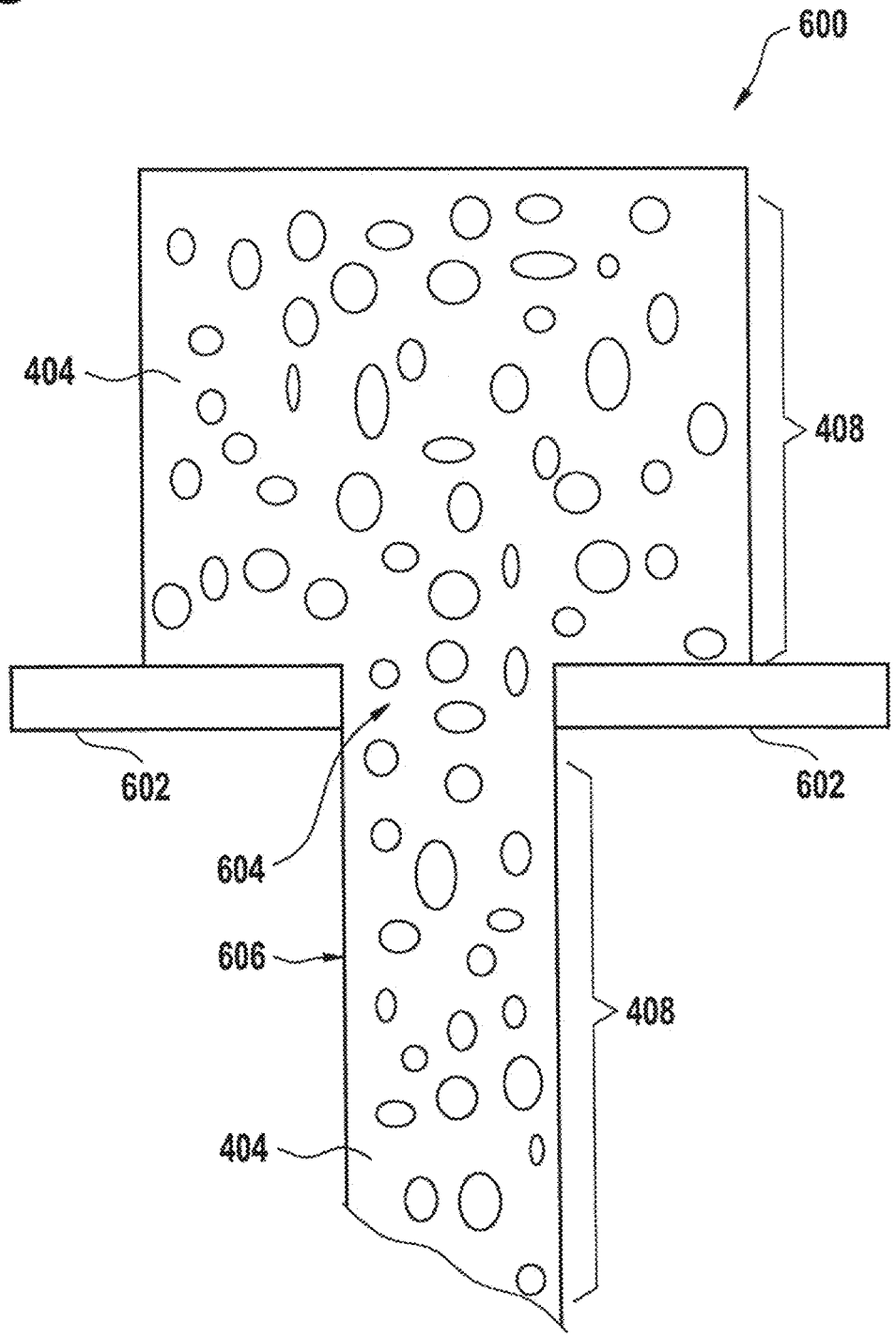
FIG. 6 illustrates the extrusion of the polymer mixture into a monofilament.

FIG. 6 illustrates the extrusion of the polymer mixture into a monofilament. Shown is an amount of polymer mixture 600. Within the polymer mixture 600 there is a large number of polymer beads 408. The polymer beads 408 may be made of one or more polymers that is not miscible with the second polymer and is also separated from the second polymer by a compatibilizer. A screw, piston or other device is used to force the polymer mixture 600 through a hole 604 in a plate 602. This causes the polymer mixture 600 to be extruded into a monofilament 606. The monofilament 606 is shown as containing polymer beads 408 also. The second polymer in the second phase 404 and the polymer beads 408 are extruded together. In some examples the second polymer will be less viscous than the polymer beads 408 comprising the first polymer and the polymer beads 408 will tend to concentrate in the center of the monofilament 606. This may lead to desirable properties for the final artificial turf fiber as this may lead to a concentration of the thread-like regions in the core region of the monofilament 606. However, the composition of the first and second phases and in particular the first and second polymers are chosen such (e.g. in respect to polymer chain length, number and type of side chains, etc.) that the first phase has a higher viscosity than the second phase and that the beads and the thread-like regions concentrate in the core region in the monofilament, whereby there are still sufficient amounts of the beads and the thread-like regions on the surface of the monofilament to result in a marbled color texture on the surface of the monofilament.

Figure 7:
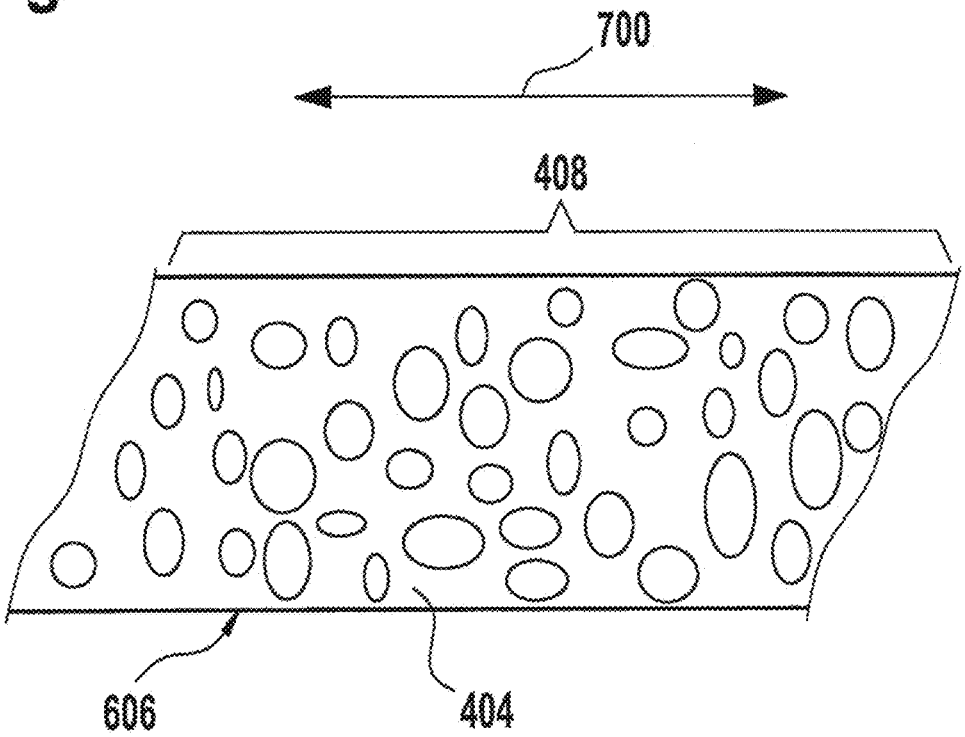
FIG. 7 shows a cross-section of a small segment of the monofilament.

FIG. 7 shows a cross-section of a small segment of the monofilament 606. The monofilament is again shown as comprising the second polymer 404 with the polymer beads 408 mixed in. The polymer beads 408 are separated from the second polymer by compatibilizer which is not shown. To form the thread-like structures a section of the monofilament 606 is heated and then stretched along the length of the monofilament 606. This is illustrated by the arrows 700 which show the direction of the stretching. The first and second polymers have different colors. In case the surface of a monofilament is abraded, the marbled color pattern is still visible as the two different dyes are not confined to the surface region. Nevertheless, the fine-granular embedding of the first phase into the second phase prevents a delamination of the two different polymers or polymer phases.

Figure 8:
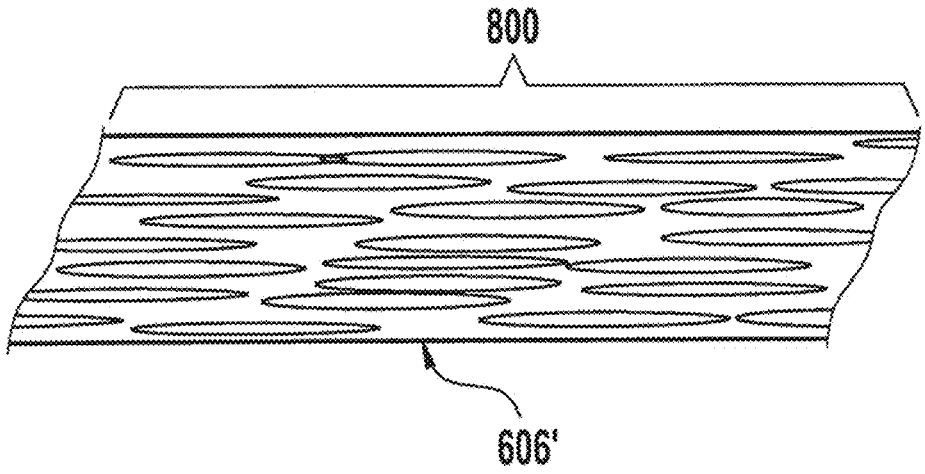
FIG. 8 illustrates the effect of stretching the monofilament.

FIG. 8 illustrates the effect of stretching the monofilament 606. In FIG. 8 an example of a cross-section of a stretched monofilament 606 is shown. The polymer beads 408 in FIG. 7 have been stretched into thread-like structures 800. The amount of deformation of the polymer beads 408 would be dependent upon how much the monofilament 606' has been stretched.

Examples may relate to the production of artificial turf which is also referred to as synthetic turf. In particular, the invention relates to the production of fibers that imitate grass both in respect to mechanical properties (flexibility, surface friction) as well as optical properties (color texture). The fibers are composed of first and second phases that are not miscible and differ in material characteristics as e.g. stiffness, density, polarity and in optical characteristics due to the two different dyes. In some embodiments, a fiber may in addition comprise a compatibilizer and further components.

In a first step, the polymer mixture comprising two or more different phases respectively comprising a polymer and a dye and optionally some additional substances is generated whereby the quantity of the second polymer is about 80-90 mass percent of the polymer mixture. The quantities of the first phase which may mainly consist of the first polymer may be 5% to 10% by mass of the polymer mixture and the quantity of a third phase being largely or completely comprised of the compatibilizers being 5% to 10% by mass of the polymer mixture. Using extrusion technology results in a mixture of droplets or of beads of the first polymer surrounded by the compatibilizer that is dispersed in the polymer matrix of the second polymer and that have a different color than the second phase.

The melt temperature used during extrusion is dependent upon the type of polymers and compatibilizer that is used. However the melt temperature is typically between 230° C. and 280° C.

A monofilament, which can also be referred to as a filament or fibrillated tape, is produced by feeding the mixture into an fiber producing extrusion line. The melt mixture is passing the extrusion tool, i.e., a spinneret plate or a wide slot nozzle, forming the melt flow into a filament or tape form, is quenched or cooled in a water spin bath, dried and stretched by passing rotating heated godets with different rotational speed and/or a heating oven.

The monofilament or type is then annealed online in a second step passing a further heating oven and/or set of heated godets.

By this procedure the beads or droplets of the first phase (optionally surrounded by a compatibilizer phase) are stretched into longitudinal direction and form small fiber like, linear structures. The majority of the linear structures is completely embedded into the polymer matrix of the second polymer but a significant portion, e.g. 5 or more % of the linear structures, are at the surface of the monofilament.

Figure 9:
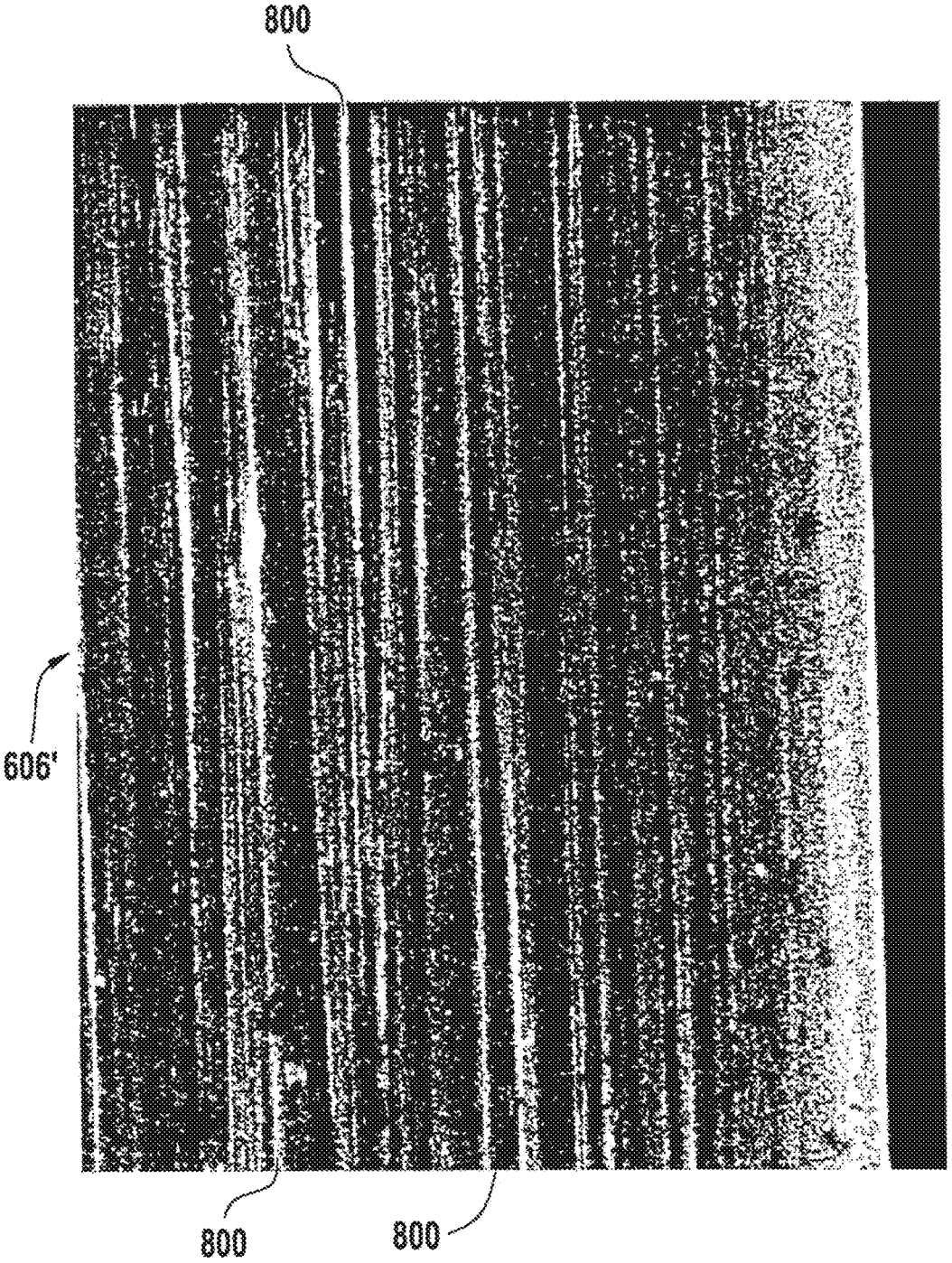
FIG. 9 shows an electron microscope picture of a cross-section of a stretched monofilament.

FIG. 9 shows a microscopic picture of a cross-section of a stretched monofilament manufactured using an example of a method described above. The horizontal white streaks within the stretched monofilament 606 are the thread-like structures 800. Several of these thread-like structures are labeled 800. The thread-like structures 800 can be shown as forming small linear structures of the first polymer within the second polymer.

The resultant fiber may have multiple advantages, namely softness combined with durability and long term elasticity. In case of different stiffness and bending properties of the polymers the fiber can show a better resilience (this means that once a fiber is stepped down it will spring back) In case of a stiff first polymer, the small linear fiber structures built in the polymer matrix are providing a polymer reinforcement of the fiber.

Delimitation due to the composite formed by the first and second polymers is prevented due to the fact that the short fibers of the second polymer are embedded in the matrix given by the first polymer.

Figure 10:
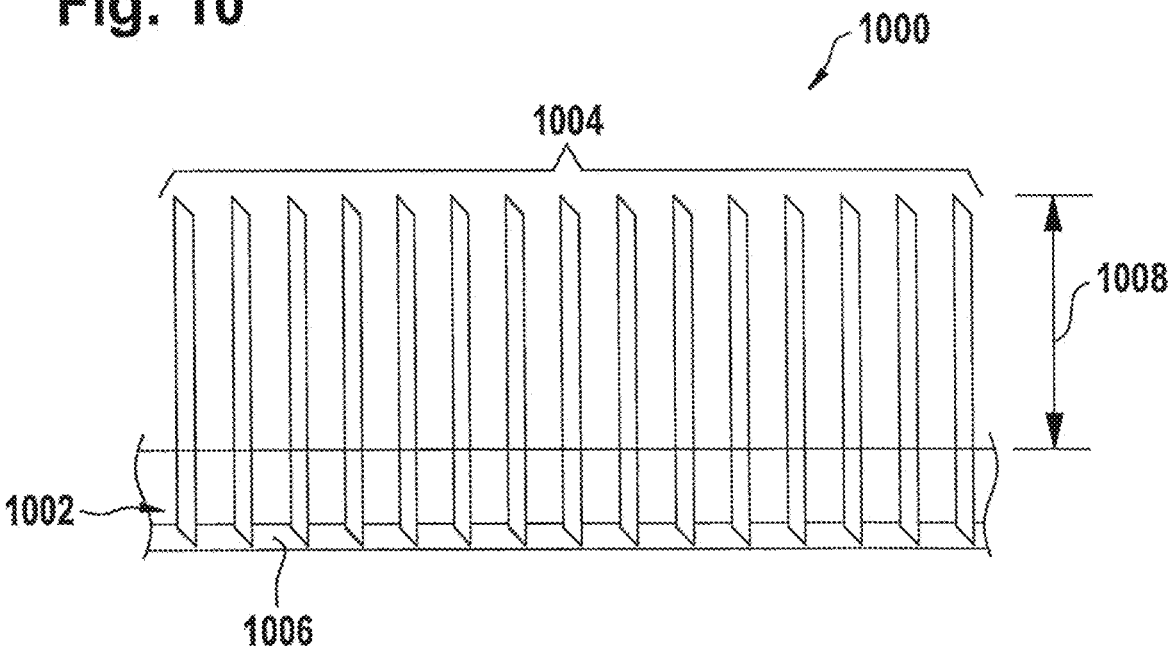
FIG. 10 shows an example of a cross-section of an example of artificial turf.

FIG. 10 shows an example of a cross-section of an example of artificial turf 1000. The artificial turf 1000 comprises an artificial turf backing 1002. Artificial turf fiber 1004 has been tufted into the artificial turf backing 1002. On the bottom of the artificial turf backing 1002 is shown a coating 1006. The coating may serve to bind or secure the artificial turf fiber 1004 to the artificial turf backing 1002. The coating 1006 may be optional. For example the artificial turf fibers 1004 may be alternatively woven into the artificial turf backing 1002. Various types of glues, coatings or adhesives could be used for the coating 1006. The artificial turf fibers 1004 are shown as extending a distance 1008 above the artificial turf backing 1002. The distance 1008 is essentially the height of the pile of the artificial turf fibers 1004. The length of the thread-like regions within the artificial turf fibers 1004 is half of the distance 1008 or less.

List of Reference Numerals

100-110 steps
200-210 steps
302 first color of first dye
304 second color of second dye
310 unified first phase domains of yellow color
312 unified second phase domains of green color
314 turbulent flow moulded part region
318 laminar flow moulded part region
d average distance between regions of different color
400 polymer mixture

402 first phase
404 second phase
406 third phase with compatibilizer
408 polymer bead
500 polymer mixture
502 third polymer
600 polymer mixture
602 plate
604 hole
606 monofilament
606' stretched monofilament
700 direction of stretching
800 threadlike structures
1000 artificial turf
1002 artificial turf carpet
1004 artificial turf fiber (pile)
1006 coating
1008 height of pile

The invention claimed is:

1. A method of manufacturing artificial turf, the method comprising the steps of:

creating a liquid polymer mixture, wherein the polymer mixture is a two-phase system, the polymer mixture not including a compatibilizer, a first one of the phases comprising a first polymer and a first dye, a second one of the phases of the polymer mixture comprising a second polymer and a second dye, the second dye having a different color than the first dye, the first and the second phase being immiscible, the first phase forming polymer beads within the second phase, wherein a phase separation of the first and the second phase is achieved by selecting the first and the second polymer such that the difference in melt mass-flow rate of the first and second polymer results in a phase separation of a molten mixture of the first and second polymer, wherein the first polymer is a first linear low-density polyethylene (LLDPE) having a first melt mass flow rate, wherein the second polymer is a second LLDPE having a second melt mass flow rate different from the first melt mass flow rate, wherein the first LLDPE and the second LLDPE have different molecular weights, wherein the first LLDPE has a smaller mass share of the polymer mixture and the second LLDPE has a larger share of the polymer mixture, and wherein the first melt mass flow rate (190° C/2.16 kg) is 0.5-5 g/10 min and the second melt mass flow rate (190° C/2.16 kg) is 8-100 g/10 min;

extruding the polymer mixture into a monofilament comprising a marbled pattern of the first and second color;

quenching the monofilament;

reheating the monofilament;

stretching the reheated monofilament to deform the polymer beads into a form of threadlike regions and to form the monofilament into an artificial turf fiber;

incorporating the artificial turf fiber into an artificial turf backing, wherein the creation of the liquid polymer mixture comprises heating the polymer mixture to reach at the time of extrusion a temperature of 190-260° C., and wherein the quenching is performed in a quenching solution having a temperature of 10-60° C., wherein in the marble pattern of the monofilament the occurrence of the two different first and second colors changes every 50-1000 μm.

2. The method of claim 1, wherein one of the first and the second polymers is a polar polymer and the other one is an apolar polymer and wherein the first and second polymers are chosen such that the polarity difference of the polar and the apolar polymer results in the phase separation of the first and second phase.

3. The method of claim 1, wherein the second polymer is a non-polar polymer and/or wherein the first polymer is a polar polymer.

4. The method of claim 1, wherein the polymer beads comprises crystalline portions and amorphous portions, wherein stretching the polymer beads into the form of threadlike regions causes an increase in the size of the crystalline portions relative to the amorphous portions.

5. The method of claim 1, wherein the creation of the polymer mixture comprises the steps of:

forming a first mixture comprising the first polymer;

heating the first mixture;

extruding the first mixture having a predefined shape or a predefined size, wherein a size of the polymer beads is based upon the predefined size or the predefined shape of the extruded first mixture;

granulating the extruded first mixture;

mixing the granulated first mixture with the second polymer, the second polymer being not granulated; and heating the granulated first mixture with the second polymer to form the polymer mixture.

6. The method of claim 1, wherein the first polymer is any one of the following: polyamide, polyethylene terephthalate (PET), and polybutylene terephthalate (PBT).

7. The method of claim 1, wherein the second polymer is any one of the following: polyethylene, polypropylene, and a mixture thereof.

8. The method of claim 1, the extrusion being performed at a pressure of 40-140 bars.

9. The method of claim 1, wherein the polymer mixture comprises 0.2 to 40 percent by weight the first polymer.

10. The method of claim 1, wherein the polymer mixture comprises more than 70 percent by weight the second polymer.

11. The method of claim 1, wherein the first dye is an azo-nickel pigment complex in a concentration of 0.5-5 by weight of the first phase and/or wherein the second dye is phthalocyanin green in a concentration of 0.001-0.3 % by weight of the second phase.

12. The method of claim 1, wherein the artificial turf fiber extends a predetermined length beyond the artificial turf backing, and wherein the form of threadlike regions have a length less than one half of the predetermined length.

13. An artificial turf according to the method of claim 1, comprising an artificial turf textile backing and the artificial turf fiber incorporated into the artificial turf textile backing, wherein the artificial turf fiber comprises at least one monofilament including a surface, the at least one monofilament comprising the marbled pattern of the first and the second color on the surface, wherein the monofilament is a monofilament created in the extrusion step from the liquid polymer mixture, each of the at least one monofilament comprising:

the first polymer in the form of the threadlike regions, the first polymer comprising the first dye having the first color;

the second polymer, the second polymer comprising the second dye having the second color, wherein the form of threadlike regions are embedded in the second polymer, wherein the first polymer is immiscible in the second polymer.

* * * * *